US005148740A

United States Patent [19]

Arndt et al.

[11] Patent Number: 5,148,740

[45] Date of Patent: Sep. 22, 1992

[54] ROTARY PELLETIZING MACHINE WITH MATRIX DISC HAVING COPPER AND LOWER PLUNGERS

[75] Inventors: Ulrich Arndt, Lauenburg; Peter Lüneburg, Berkenthien; Kurt Marquardt, Hamburg; Hans-Joachim Pierags, Lübeck; Ulrich Zeuschner; Günter Harten, both of Schwarzenbek, all of Fed. Rep. of Germany

[73] Assignee: Firma Wilhelm Fette GmbH, Schwarzenbek, Fed. Rep. of Germany

[21] Appl. No.: 667,016

[22] Filed: Mar. 8, 1991

[30] Foreign Application Priority Data

Jun. 8, 1990 [DE] Fed. Rep. of Germany ..... 4018401

[51] Int. Cl.[5] ..... B30B 5/00; B30B 11/08

[52] U.S. Cl. ..... 100/264; 100/906; 425/186; 425/345

[58] Field of Search ..... 100/223, 244, 264, 903, 100/906; 425/220, 231, 344, 345, 353, 354, 182, 186, 193

[56] References Cited

U.S. PATENT DOCUMENTS

| | | | |
|---|---|---|---|
| 2,997,741 | 8/1961 | Crossley | 100/264 X |
| 4,362,491 | 12/1982 | Livingstone | 425/186 |
| 4,408,975 | 10/1983 | Hack | 425/345 X |
| 4,793,791 | 12/1988 | Kokuryo | 425/345 |
| 4,988,275 | 1/1991 | Hinzpeter et al. | 425/345 X |
| 5,004,413 | 4/1991 | Stopforth | 425/186 X |

FOREIGN PATENT DOCUMENTS

| | | | |
|---|---|---|---|
| 846301 | 7/1981 | U.S.S.R. | 425/186 |

*Primary Examiner*—Harvey C. Hornsby
*Assistant Examiner*—Stephen F. Gerrity
*Attorney, Agent, or Firm*—Michael J. Striker

[57] ABSTRACT

A rotary pelletizing machine comprises a rotatable matrix disc, a plurality of upper plungers and lower plungers guided in the matrix disc, and an element for holding the lower plungers from falling out during a dismounting of the matrix disc, the holding element including a braking ring arranged in the matrix disc and pressing radially against the lower plungers so as to hold the lower plungers from falling out.

10 Claims, 1 Drawing Sheet

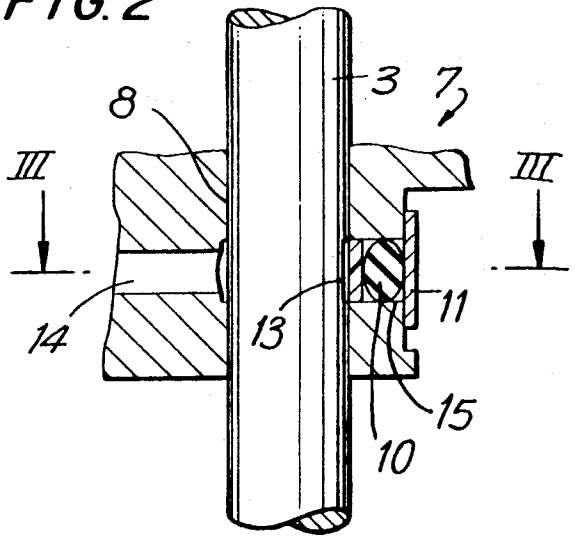
FIG. 2
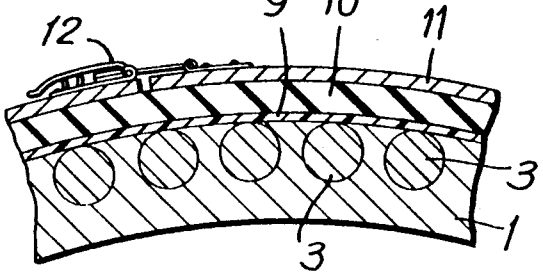
FIG. 3
FIG. 1
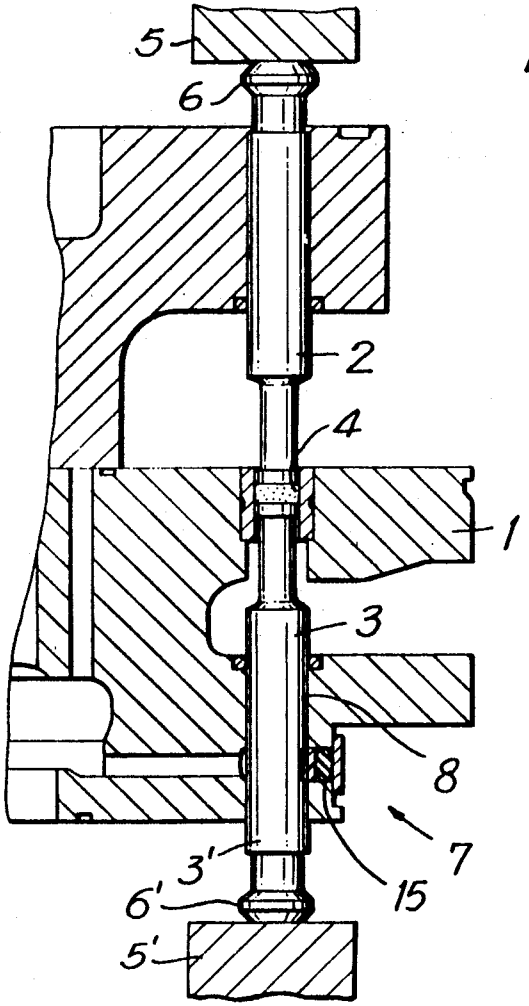

ROTARY PELLETIZING MACHINE WITH MATRIX DISC HAVING COPPER AND LOWER PLUNGERS

BACKGROUND OF THE INVENTION

The present invention relates to a rotary pelletizing machine.

More particularly, it relates to a rotary pelletizing machine with rotatably supported matrix disc, a plurality of upper and lower plungers provided in the matrix disc so that their position during rotation of the matrix disc is controlled by rails or pressing rollers, and holders for holding the lower plungers from falling out of the matrix disc during dismounting.

When pelletizing machines are used it is necessary to convert a machine for subsequent manufacture of other pellet types or for cleaning of individual machine parts. For an efficient utilization of a pelletizing machine it is advantageous when the time for such a conversion of the machine or for cleaning its machine parts is as short as possible in comparison with the operation time or the production time. For maintaining as short as possible the time required for a conversion of the machine for example for a different plunger pitch or another plunger pressure or for cleaning it is advantageous when the matrix disc with the upper and lower plungers can be exchanged as simple as possible. At the same time it is necessary to hold the lower plungers so that they are securely maintained in the matrix disc and do not fall out of the latter during the dismounting. Known arrangements for such a securing possess certain disadvantages with respect to the above mentioned short time requirement.

The lower plungers must not fall out of the matrix disc when the lower control cams are dismounted or when during an exchange of the matrix disc the lower pressing rollers and guiding rails release individual lower plungers. For this purpose the lower plungers which are used in great numbers in the machine are provided with individual holders. These known holders for the individual lower plungers include a pressure member which is clamped radially against a plunger shaft of the lower plunger. For securing each individual lower plunger in the machine in which a matrix disc for example has 80 pieces, a corresponding number of the pressing pieces must be used with an exactly predetermined torque. This is naturally associated with significant mounting expenses. The individual pressing pieces must be secured so that they are not loosened. When during the operation individual synthetic plastic heads of the pressure pieces are worn, they must be individually exchanged.

SUMMARY OF THE INVENTION

Accordingly, it is an object of the present invention to provide a rotary pelletizing machine which avoids the disadvantages of the prior art.

More particularly, it is an object of the present invention to provide a rotary pelletizing machine in which securing the lower plungers from their falling out from the matrix disc is achieved in a significantly simpler manner and shorter time.

In keeping with these objects and with others which will become apparent hereinafter, one feature of the present invention resides, briefly stated, in a rotary pelletizing machine in which the holding means for the lower plungers include a braking ring which is arranged in the matrix disc and presses radially against the shafts of all lower plungers so that it is not necessary to secure them individually.

When the rotary pelletizing machine is designed in accordance with the present invention it eliminates the above mentioned disadvantages of the prior art and provides for the above specified highly advantageous results.

In accordance with another feature of the present invention the braking ring can be arranged with a peripheral circular groove of the matrix disc, which groove communicates with openings for receiving individual plungers, through connecting openings. This can be achieved in a simple manner by a corresponding depth of the groove.

Since the new braking ring simultaneously acts on all lower plungers in the same manner, it is no longer necessary during exchange of the lower plungers to release a plurality of securing elements and then again to adjust the securing elements. Instead, it suffices to release the braking band which simultaneously releases all lower plungers and then clamp the braking band for simultaneous securing of all lower plungers. For this purpose it is advantageous when in accordance with a further feature of the present invention the braking band or the braking ring is provided with a clamping lock.

It is also advantageous when in accordance with still a further feature of the present invention the braking ring carries a wear band at its inner side. The wear band can be composed for example of synthetic plastic material. A wear of a member which transmits a spring pressure can be prevented in accordance with still another feature of the present invention, for example by an O-ring. A pressure can be applied against the O-ring by an outwardly located clamping band. This arrangement also has a significant advantage that during a partial wear of the wear band it suffices to turn insignificantly the whole braking ring so that a new portion of the wear band directly abuts against the shafts of the lower plungers.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view showing a matrix disc of a pelletizing machine in accordance with the present invention with a plurality of upper and lower plungers partially in section;

FIG. 2 is a view showing a partial section of FIG. 1 on an enlarged scale; and FIG. 3 is a view showing a section taken along the line III—III in FIG. 2.

DESCRIPTION OF THE PREFERRED EMBODIMENT

A rotary pelletizing machine in accordance with the present invention is shown in FIG. 1 and has a matrix disc which is identified as a whole with reference numeral 1 and shown in a cross-section. An upper plunger 2 and a lower plunger 3 are guided in the matrix disc 1 in a vertically adjustable manner for producing pellets in matrix openings 4.

Pressing of a pellet is performed in a pre-pressing station and a main pressing station by pre-pressing rollers and main pressing rollers, respectively. Transition rails or guiding rails 5 and 5' are located between the pre-pressing rollers and the main pressing rollers. They are provided for the upper plunger 2 and lower plunger 3 and arranged so that the upper plunger 2 and lower plunger 3 abuts and 5' with their heads 6 and 6' against the transition rails or guiding rails 5 an 5' respectively.

When the matrix disc 1 with its upper plungers 2 and lower plungers 3 is removed from the machine for example for cleaning or exchange of the plungers, there is a danger that the lower plungers 3 can fall out. For preventing such an occurrence, a braking ring 7 is provided in the machine. The braking ring 7 is arranged in a ring-shaped groove 15 which surrounds the matrix disc 11 and has a square or a rectangular cross-section. The matrix disc has a plurality of openings 8 for receiving the plungers 3. The groove 15 is worked in the matrix disc so deep that it communicates with the openings 8 through elliptic openings 13. The braking ring 7 engages in the opening 13 with its wear band applied on its inner side.

The wear band is identified with reference numeral 9 and composed for example of a wear resistant synthetic plastic material. The wear band 9 is arranged under the pressure of an 0-ring 10. The 0-ring 10 is composed of an elastic material such as for example rubber and compressed by a clamping band 11. The latter is provided with a clamping lock 12 for opening and closing of the whole braking ring 7. All lower plungers 3 can be secured from falling out by the braking ring 7. The braking ring 7 is also suitable for preventing vibrations of the lower plungers. Such vibrations occur especially during overrunning of the pressing rollers which are not shown in the drawings.

A further advantage of the braking ring is that it operates in an automatically adjustable manner since the O-ring 10 applies continuously a pressure from outside onto the wear band 9. When stronger wear occurs in the wear band 9, it suffices to turn insignificantly the braking ring 7 inside the groove 15 and to clamp it further, so that it can be used over a longer time.

As can be seen from the drawing, the braking ring 7 cooperates with a shaft 3' of the lower plunger 3.

It will be understood that each of the elements described above, or two or more together, may also find a useful application in other types of constructions differing from the types described above.

While the invention has been illustrated and described as embodied in a rotary pelletizing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A rotary pelletizing machine, comprising a rotatable matrix disc; a plurality of upper plungers and lower plungers guided in said matrix disc; and means for holding said lower plungers form falling out during a dismounting of said matrix disc, said holding means including a braking ring arranged in said matrix disc and pressing radially against said lower plungers so as to hold said lower plungers from falling out, said matrix disc being provided with a peripheral groove in which said braking ring is arranged, said matrix disc having a plurality of openings for receiving said lower plungers, and a plurality of connecting openings, said peripheral groove being connected with said openings for receiving said lower plungers through said connecting openings.

2. A rotary pelletizing machine as defined in claim 1, wherein each of said lower plungers has a shaft, said braking ring being arranged to press radially against said shaft of each of said lower plungers.

3. A rotary pelletizing machine as defined in claim 1; and further comprising means for controlling a position of said upper plungers and said lower plungers during rotation of said matrix disc.

4. A rotary pelletizing machine as defined in claim 3, wherein said controlling means include a plurality of rails.

5. A rotary pelletizing machine, comprising a rotatable matrix disc; a plurality of upper plungers and lower plungers guided in said matrix disc; and means for holding said lower plungers from falling out during a dismounting o said matrix disc, said holding means including a braking ring arranged in said matrix disc and pressing radially against said lower plungers so as to hold said lower plungers from falling out, said braking ring having an O-ring, and a clamping band located outside of said O-ring and holding said O-ring against said matrix disc.

6. A rotary pelletizing machine as define in claim 5, wherein said matrix disc is provided with a peripheral groove, said braking ring being arranged in said peripheral groove.

7. A rotary pelletizing machine as defined in claim 5, wherein said clamping band is provided with a clamping lock.

8. A rotary pelletizing machine as defined in claim 7, wherein said O-ring is composed of an elastic material, said clamping band being composed of metal.

9. A rotary pelletizing machine as defined in claim 7, wherein said braking ring has an inner side; and further comprising a wear band arranged at said inner side of said braking disc, said wear band being composed of synthetic plastic material, said O-ring being composed of an elastic material, said clamping band being composed of metal.

10. A rotary pelletizing machine, comprising a rotatable matrix disc; a plurality of upper plungers an lower plungers guided in said matrix disc; means for holding said lower plungers from falling out during a dismounting of said matrix disc, said holding means including a braking ring arranged in said matrix disc and pressing radially against said lower plungers so as to hold said lower plungers from falling out, said braking ring having an inner side; and a wear band arranged on said inner side of said braking ring.

* * * * *